US010804025B2

(12) United States Patent
Jang

(10) Patent No.: US 10,804,025 B2
(45) Date of Patent: Oct. 13, 2020

(54) COIL COMPONENT AND METHOD FOR FABRICATING THE SAME

(71) Applicant: SAMSUNG ELECTRO-MECHANICS CO., LTD., Suwon-si, Gyeonggi-do (KR)

(72) Inventor: Jin Hyuk Jang, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 201 days.

(21) Appl. No.: 15/822,553

(22) Filed: Nov. 27, 2017

(65) Prior Publication Data

US 2018/0374626 A1 Dec. 27, 2018

(30) Foreign Application Priority Data

Jun. 23, 2017 (KR) ..... 10-2017-0079837

(51) Int. Cl.
*H01F 5/00* (2006.01)
*H01F 27/255* (2006.01)
(Continued)

(52) U.S. Cl.
CPC ..... *H01F 27/255* (2013.01); *H01F 5/00* (2013.01); *H01F 17/0013* (2013.01); *H01F 17/04* (2013.01); *H01F 19/00* (2013.01); *H01F 27/02* (2013.01); *H01F 27/022* (2013.01); *H01F 27/2871* (2013.01); *H01F 27/292* (2013.01); *H01F 27/323* (2013.01); *H01F 41/04* (2013.01);
(Continued)

(58) Field of Classification Search
CPC ..... H01F 5/00; H01F 27/00–40
USPC ..... 336/65, 83, 200, 206–208, 232
See application file for complete search history.

(56) References Cited

U.S. PATENT DOCUMENTS 6,136,458 A * 10/2000 Inoue ..... H01F 17/0006 427/128
9,812,257 B2 * 11/2017 Itoh ..... H01F 17/0013
(Continued)

FOREIGN PATENT DOCUMENTS

CN 1307658 C 3/2007
CN 104700982 A 6/2015
(Continued)

OTHER PUBLICATIONS

Office Action issued in corresponding Korean Patent Application No. 10-2017-0079837, dated Jul. 9, 2018.
(Continued)

*Primary Examiner* — Tuyen T Nguyen
(74) *Attorney, Agent, or Firm* — Morgan, Lewis & Bockius LLP

(57) ABSTRACT

A coil component may include a body having a support member including a through hole, a coil disposed on at least one of an upper surface and a lower surface of the support member, and a magnetic material encapsulating the coil and the support member, and filling the through hole. The coil includes a coil pattern. The coil component further includes an external electrode connected to the coil. At least one of the upper surface and the lower surface of the support member includes a groove, having a shape corresponding to a shape of the coil pattern, and at least a portion of the coil pattern is embedded in the groove.

9 Claims, 7 Drawing Sheets

(51) Int. Cl.

| | |
|---|---|
| ***H01F 19/00*** | (2006.01) |
| ***H01F 41/04*** | (2006.01) |
| ***H01F 27/28*** | (2006.01) |
| ***H01F 27/02*** | (2006.01) |
| ***H01F 17/04*** | (2006.01) |
| ***H01F 17/00*** | (2006.01) |
| ***H01F 27/29*** | (2006.01) |
| ***H01F 27/32*** | (2006.01) |

(52) U.S. Cl.
CPC ..... *H01F 41/041* (2013.01); *H01F 2017/048* (2013.01)

(56) References Cited

U.S. PATENT DOCUMENTS

| | | | | |
|---|---|---|---|---|
| 2005/0006713 | A1* | 1/2005 | Shim | G01R 33/02 257/421 |
| 2005/0140488 | A1 | 6/2005 | Shimoyama et al. | |
| 2009/0128275 | A1 | 5/2009 | Yagasaki et al. | |
| 2014/0176288 | A1* | 6/2014 | Jung | H01F 27/255 336/207 |
| 2015/0155093 | A1 | 1/2015 | Kim et al. | |
| 2015/0294789 | A1 | 10/2015 | Sano et al. | |
| 2017/0032884 | A1 | 2/2017 | Choi et al. | |
| 2017/0040101 | A1* | 2/2017 | Jeong | H01F 27/2804 |
| 2017/0062121 | A1 | 3/2017 | Yang et al. | |
| 2018/0374626 | A1* | 12/2018 | Jang | H01F 27/255 |

FOREIGN PATENT DOCUMENTS

| | | | |
|---|---|---|---|
| CN | 104756211 | A | 7/2015 |
| CN | 106409469 | A | 2/2017 |
| EP | 2 916 336 | A1 | 9/2015 |
| JP | 2004-111597 | A | 4/2004 |
| JP | 5084459 | B2 | 11/2012 |
| KR | 10-2015-0079935 | A | 7/2015 |
| KR | 10-2017-0023621 | A | 3/2017 |
| KR | 10-2017-0060577 | A | 6/2017 |

OTHER PUBLICATIONS

Office Action issued in corresponding Chinese Patent Application No. 201810062967.0 dated Jul. 1, 2020, with English translation.

* cited by examiner

COIL COMPONENT AND METHOD FOR FABRICATING THE SAME

CROSS-REFERENCE TO RELATED APPLICATION

This application claims the benefit of priority to Korean Patent Application No. 10-2017-0079837, filed on Jun. 23, 2017 in the Korean Intellectual Property Office, the disclosure of which is incorporated herein by reference in its entirety.

TECHNICAL FIELD

The present disclosure relates to a coil component and a method for fabricating the same, and more particularly, to a thin film type power inductor and a method for fabricating the same.

BACKGROUND

Recently, with the trend for miniaturization and thinning of smartphones and wearable devices, the sizes of chips included in power inductors has been reduced, and composite materials using magnetic metallic materials have been used in power inductors to achieve high efficiency.

Efforts have been undertaken to realize miniaturized power inductors having features such as high inductance and low direct current resistance (Rdc), due to the limitations of chip size. For example, the content of a magnetic material may be increased for the same chip size by changing a C-shaped external electrode extending to the upper surface of a conventional chip to an L-shaped external electrode not extending to the upper surface of the conventional chip. However, notwithstanding this effort, the problems caused by delamination, due to difficulties in securing adhesion between heterogeneous materials or by an increase in the content of magnetic materials, have not been solved.

SUMMARY

An aspect of the present disclosure may provide a coil component that may provide high capacity by increasing an aspect ratio (AR) of a coil while miniaturizing a chip size, and a method for fabricating the same.

A coil component may include a body having a support member including a through hole, a coil disposed on at least one of an upper surface and a lower surface of the support member, and a magnetic material encapsulating the coil and the support member, and filling the through hole. The coil includes a coil pattern. The coil component further includes an external electrode connected to the coil. At least one of the upper surface and the lower surface of the support member includes a groove, having a shape corresponding to a shape of the coil pattern, and at least a portion of the coil pattern is embedded in the groove.

According to another aspect of the present disclosure, a method for fabricating a coil component may include forming a via hole in the support member, forming a groove in at least one of an upper surface and a lower surface of the support member, forming a base conductive layer on a side surface of the via hole and on the upper surface and the lower surface of the support member, and forming insulating patterns on portions of the upper surface and the lower surface where the groove is not formed. The method may further include forming a coil pattern layer in a space between the insulating patterns, the coil pattern layer filling the groove, removing the insulating patterns, and removing portions of the base conductive layer exposed by removing the insulating patterns. The method may further include forming a body by encapsulating the coil pattern layer and the support member in a magnetic material, and forming an external electrode on an external surface of the body, the external electrode being electrically connected to the coil pattern layer.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
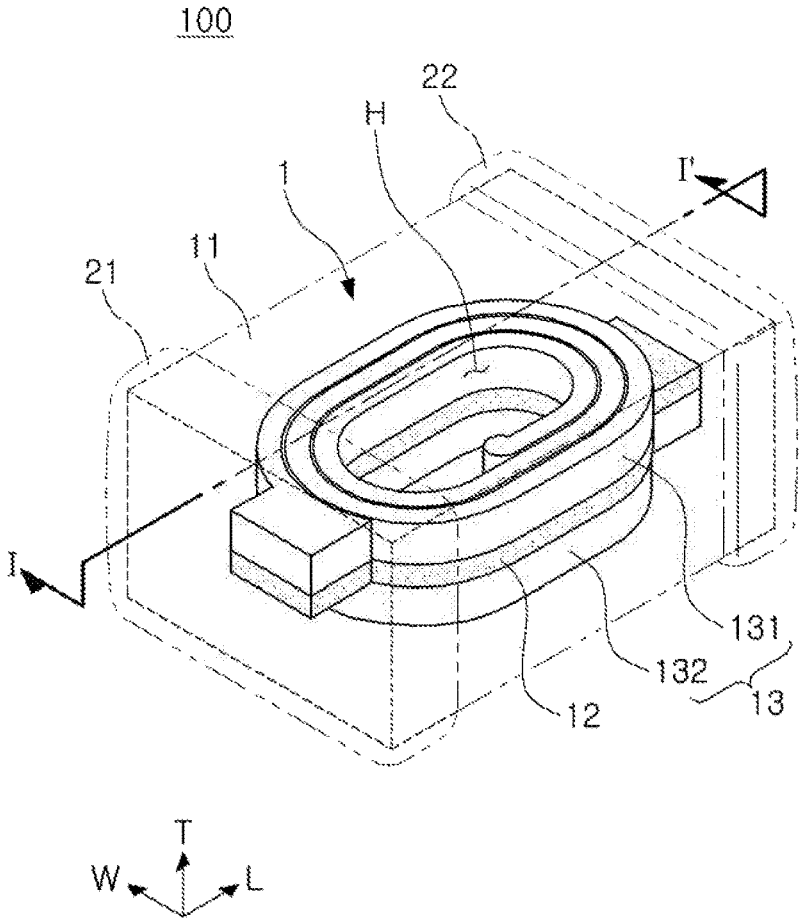
FIG. 1 is a schematic perspective view of a coil component, according to an embodiment.

Hereinafter, embodiments of the present disclosure will be described with reference to the accompanying drawings. In the accompanying drawings, shapes, sizes and the like, of the components may be exaggerated or shortened for clarity.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region or wafer (substrate), is referred to as being "on," "connected to," or "coupled to" another element, it can be directly "on," "connected to," or "coupled to" the other element, or other elements intervening therebetween may be present. In contrast, when an element is referred to as being "directly on," "directly connected to," or "directly coupled to" another element, there may be no other elements or layers intervening therebetween. Like numerals refer to like elements throughout. As used herein, the term "and/or" includes any and all combinations of one or more of the associated, listed items.

It will be apparent that, although the terms 'first,' 'second,' 'third,' etc. may be used herein to describe various members, components, regions, layers and/or sections, these members, components, regions, layers and/or sections should not be limited by these terms. These terms are only used to distinguish one member, component, region, layer or section from another region, layer or section. Thus, a first member, component, region, layer or section discussed below could be termed a second member, component, region, layer or section without departing from the teachings of the embodiments.

Spatially relative terms, such as "above," "upper," "below," and "lower" or the like, may be used herein for ease of description to describe one element's relationship relative to another element(s), as shown in the figures. It will be understood that spatially relative terms are intended to encompass different orientations of the device in use or operation, in addition to the orientation depicted in the figures. For example, if the device in the figures is turned over, elements described as "above," or "upper" relative to other elements would then be oriented "below," or "lower" relative to the other elements or features. Thus, the term "above" can encompass both the above and below orientations, depending on a particular directional orientation of the figures. The device may be otherwise oriented (rotated 90 degrees or at other orientations) and the spatially relative descriptors used herein may be interpreted accordingly.

The terminology used herein describes particular embodiments only, and the present disclosure is not limited thereby. As used herein, the singular forms "a," "an," and "the" are intended to include the plural forms as well, unless the context clearly indicates otherwise. It will be further understood that the terms "comprises," and/or "comprising" when used in this specification, specify the presence of stated features, integers, steps, operations, members, elements, and/or groups thereof, but do not preclude the presence or addition of one or more other features, integers, steps, operations, members, elements, and/or groups thereof.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape resulting from manufacturing. The following embodiments may also be constituted alone or as a combination of several or all thereof.

The contents of the present disclosure described below may have a variety of configurations, and only a required configuration is proposed herein, but the present disclosure is not limited thereto.

Hereinafter, a coil component, according to an embodiment, and a method for fabricating the same are described. However, the present disclosure is not limited thereto.

Coil Component

FIG. 1 is a schematic perspective view of a coil component 100, according to an embodiment. Referring to FIG. 1, the coil component 100 includes a body 1, and a first external electrode 21 and a second external electrode 22 disposed on an external surface of the body 1.

The body 1 forms an overall exterior of the coil component 100, has an upper surface and a lower surface opposing each other in a thickness direction T, a first end surface and a second end surface opposing each other in a length direction L, and a first side surface and a second side surface opposing each other in a width direction W. The various surfaces of the body 1 form a substantially hexahedral shape. However, the present disclosure is not limited thereto.

The body 1 further includes a magnetic material 11, having magnetic properties. For example, the magnetic material 11 may be formed by incorporating ferrite or magnetic metallic particles in a resin. In an embodiment, the magnetic metallic particles may include at least one selected from iron (Fe), silicon (Si), chromium (Cr), aluminum (Al), nickel (Ni), and any combination thereof.

Figure 2:
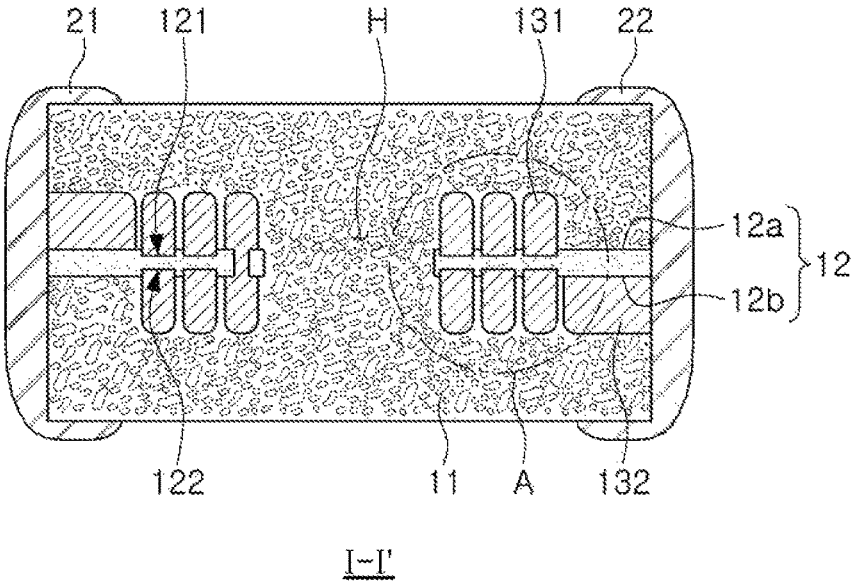
FIG. 2 is a schematic cross-sectional view taken along line I-I' of FIG. 1.

The first and second external electrodes 21 and 22, disposed on at least a portion of the external surface of the body 1, are illustrated in FIG. 2 as having a "C" shape. However, detailed shapes of the first and second external electrodes 21 and 22 are not limited. For example, the first and second external electrodes 21 and 22 may not extend to the upper surface of the body 1, due to having an "L" shape, and may also be provided as lower electrodes only disposed on the lower surface of the body 1, if desired. The first external electrode 21 and the second external electrode 22 need not have the same shape. For example, in an embodiment, the first external electrode 21 is C-shaped and the second external electrode 22 is L-shaped.

The first and second external electrodes 21 and 22 are electrically connected to a coil 13 included in the body 1, and thus include, for example, materials having improved electrical conductivity. The first and second external electrodes 21 and 22 may be formed of, for example, nickel (Ni), copper (Cu), silver (Ag), or alloys thereof, and may also be formed as multilayer structures. In some cases, each of the first and second external electrodes 21 and 22 may be formed by forming a wiring plated with copper (Cu) in an innermost portion thereof and then disposing a plurality of plating layers on the wiring. However, materials and formation methods of the first and second external electrodes 21 and 22 are not limited thereto.

When viewed from an interior of the body 1, the body 1 includes the coil 13 encapsulated in magnetic material 11 and a support member 12 supporting the coil 13. The coil 13 includes a plurality of coil patterns. In an embodiment, the coil 13 includes an upper coil 131 disposed on an upper surface of the support member 12 and a lower coil 132 disposed on a lower surface of the support member 12. The upper and lower coils 131 and 132 are electrically connected to each other by a via (not illustrated) in an embodiment.

The coil 13 is illustrated as having an overall spiral shape, and may be formed of a metallic material having improved electrical conductivity, for example, copper (Cu).

In an embodiment, the support member 12, supporting the coil 13, has a through hole H disposed in a central portion of the support member 12. The through hole H is filled with the magnetic material 11 to form a central portion of a magnetic core. The through hole H of the support member 12 may increase permeability of the coil component 100.

A material of the support member 12 is not particularly limited, and may be suitably selected by a person having ordinary skill in the art, according to design particulars or desired properties. For example, as a central core of a common copper clad laminate (CCL), a material including a glass fiber, or a material, such as a prepreg (PPG), a build-up film formed only of a resin, a photoimageable dielectric (PID), or the like, may be selected.

Figure 3:
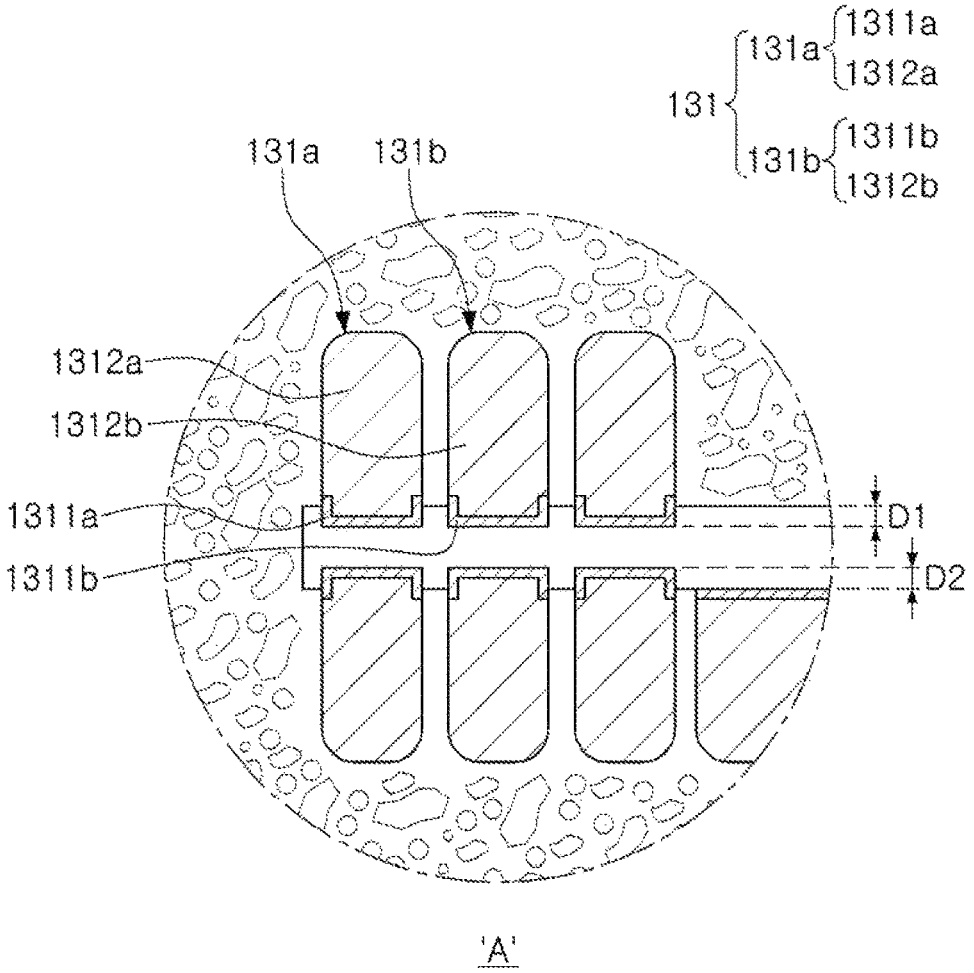
FIG. 3 is a schematic enlarged view of region A of FIG. 2.

FIG. 2 is a schematic cross-sectional view taken along line I-I' of FIG. 1, and FIG. 3 is a schematic enlarged view of region A of FIG. 2. The support member 12 and the coil 13 of the coil component 100 are described in more detail, with reference to FIGS. 2 and 3.

Referring to FIGS. 2 and 3, a first groove 121 and a second groove 122 are formed in upper and lower surfaces 12*a* and 12*b* of the support member 12, respectively. Each of the first and second grooves 121 and 122 has a shape corresponding to an overall shape of the coil 13. The overall shape of the coil 13 may be spiral. Thus, when the first and the second grooves 121 and 122 are viewed from above or below the coil component 100, each of the first and the second grooves 121 and 122 have a generally spiral shape.

A depth D1 of the first groove 121 may be substantially the same as a depth D2 of the second groove 122. The depths D1 and D2 of the first and second grooves 121 and 122 may be suitably changed by a person of ordinary skill in the art, according to design particulars and requirements. For example, as the first groove 121 is formed to have the spiral shape of the coil 13, the depth D1 may be changed at respective points of the first groove 121, and, as the second groove 122 is formed to have the spiral shape of the coil 13, the depth D2 may also be maintained at respective points of the second groove 122, and vice versa. It is sufficient that a sum of the depth D1 of the first groove 121 and the depth D2 of the second groove 122 at the same point is less than a thickness of the support member 12.

A cross section of each of the first and second grooves 121 and 122 is illustrated as having a rectangular shape whose widths of upper and lower portions are the same as each other. However, the cross section may be suitably changed by a person of ordinary skill in the art, according to design particulars and requirements. For example, each of the first and second grooves 121 and 122 may have a tapered shape whose width narrows in a direction inwardly of the support member 12, and may also have a trapezoidal shape. In various embodiments, the first groove 121 and the second groove 122 need not have the same shape.

The first and second grooves 121 and 122 of the support member 12 are filled with the coil patterns. For convenience and brevity of description, only a plurality of coil patterns 131*a*, 131*b*, . . . , of the upper coil 131, filling at least a portion of the first groove 121, among the coil patterns, are described. The description of the above example is also applicable to a plurality of coil patterns of the lower coil 132.

At least a lower portion of the first coil pattern 131*a* is embedded in the first groove 121. A depth to which the lower portion of the first coil pattern 131*a* is embedded in the first groove 121 may be determined by the depth D1 of the first groove 121. As the first coil pattern 131*a* is wound, the depth D1 of the first groove 121 may be changed. Thus, a depth to which the lower portion of the first coil pattern 131*a* is embedded in the first groove 121 may also be changed. The lower portion of the first coil pattern 131*a* may be embedded inwardly of the support member 12, and thus an overall aspect ratio (AR) of the coil 13 may be significantly increased. As a result, electrical properties of the coil component 100, such as direct current resistance (Rdc) or the like, may be improved.

For convenience of reference, a portion of the coil pattern embedded in the first groove 121 is referred to as a lower portion of the coil pattern. Likewise, the portion of the coil pattern not embedded in the first groove 121, i.e., an exposed portion of the coil pattern, is referred to as an upper portion of the coil pattern. A cross-sectional area of the lower portion of the coil pattern may be the same as that of the upper portion of the coil pattern. In this regard, a shape of a cross section of each of the coil patterns may be uniform. Thus, a more stable coil having a high AR may be provided.

Referring to FIG. 3, the first coil pattern 131*a* includes a base conductive layer 1311*a*, contacting side surfaces and a lower surface of a first portion of the first groove 121, and a coil pattern layer 1312*a* disposed on the base conductive layer 1311*a*. Similarly, the second coil pattern 131*b* includes a base conductive layer 1311*b*, contacting side surfaces and a lower surface of a second portion of the first groove 121, and a coil pattern layer 1312*b* disposed on the base conductive layer 1311*b*.

The base conductive layers 1311*a* and 1311*b*, and the coil pattern layers 1312*a* and 1312*b* disposed thereon may be formed of the same, or different, materials from each other. For example, in some embodiments, the coil pattern layers 1312*a* and 1312*b* are copper (Cu) plating layers, including Cu as a main component, but the base conductive layers 1311*a* and 1311*b* include a nickel (Ni) plating layer or a Ni sputtering layer including Ni as a main component. In other embodiments, both the coil pattern layers 1312*a* and 1312*b* and the base conductive layers 1311*a* and 1311*b* contain Cu as a main component.

Figure 4:
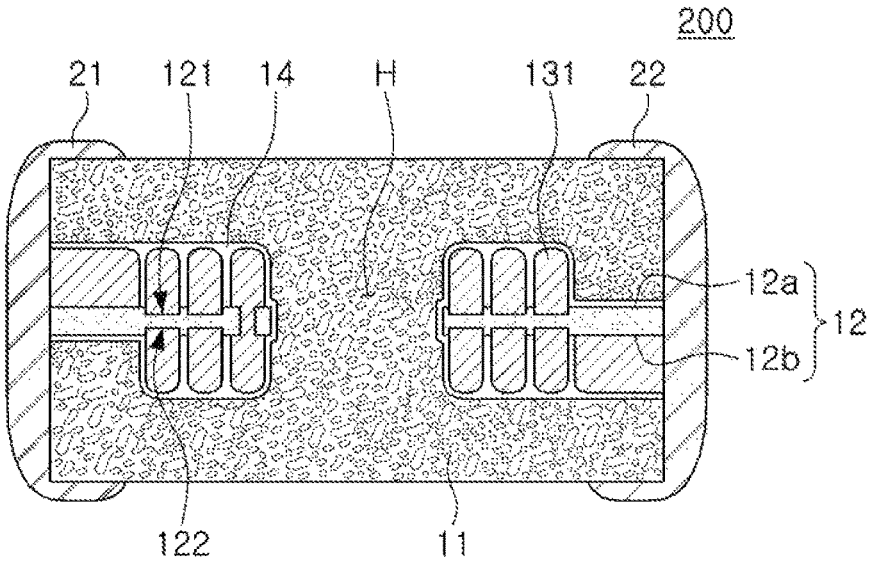
FIG. 4 is a schematic cross-sectional view of a modification of FIG. 2.

FIG. 4 illustrates a coil component 200 with an additional insulating film 14 being formed in the coil component 100 illustrated in FIG. 2. For the sake of convenient description, the reference denotations used in FIG. 2 may be applied to FIG. 4.

Although not illustrated specifically in the coil component 100 of FIG. 2, a configuration for insulation may also be provided between the coil 13 and the magnetic material 11 encapsulating the coil 13 in the coil component 100 of FIG. 2. The configuration for insulation may be, as illustrated in FIG. 4, the insulating film 14 uniformly disposed on an upper surface of the coil patterns. The insulating film 14 may be an oxide layer formed inwardly of the upper surface of the coil patterns, or may be an insulating sheet, filling spaces between the coil patterns. However, the configuration for insulation is not particularly limited.

Referring to FIG. 4, the insulating film 14 is formed to have the shape of the coil patterns, to have a uniform thickness, and may be, for example, a parylene coating layer. The parylene coating layer may be provided as a continuous, uniform insulating film formed to have a shape of the upper surface of the coil patterns, using a chemical vapor deposition (CVD) process, to thus be particularly useful for a compact coil component. Because all external surfaces of each of the base conductive layers are in contact with either the support member 12 or the coil pattern layers the insulating film 14 may be disposed on side surfaces and an upper surface of each of the coil pattern layers of the coil patterns, but not on the base conductive layers embedded in the support member 12.

Figure 5:
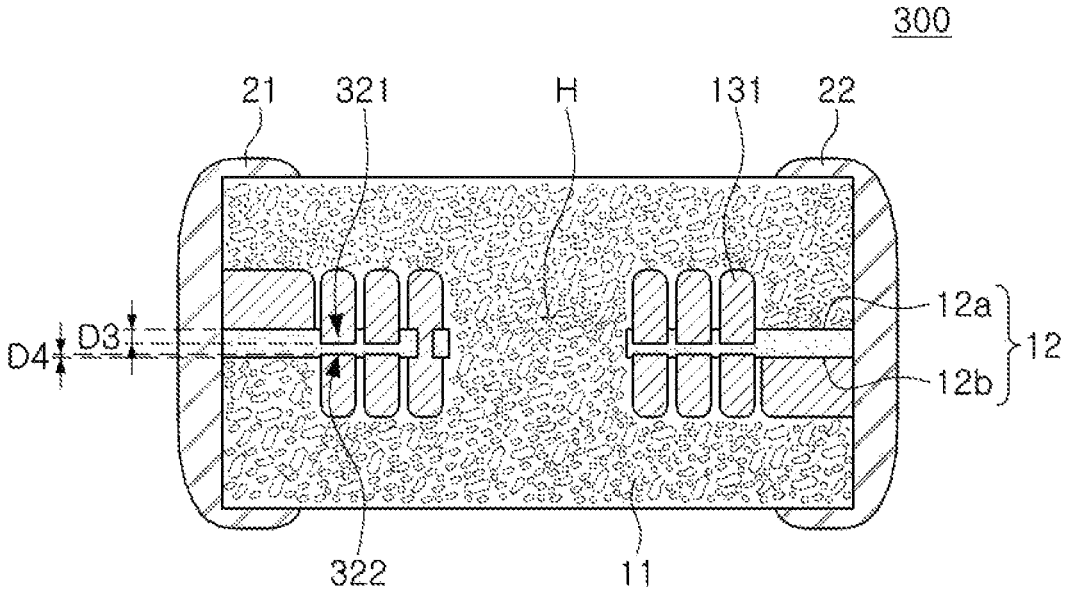
FIG. 5 is a schematic cross-sectional view taken along line I-I' of the coil component shown in FIG. 1, according to another embodiment.
Figure 6:
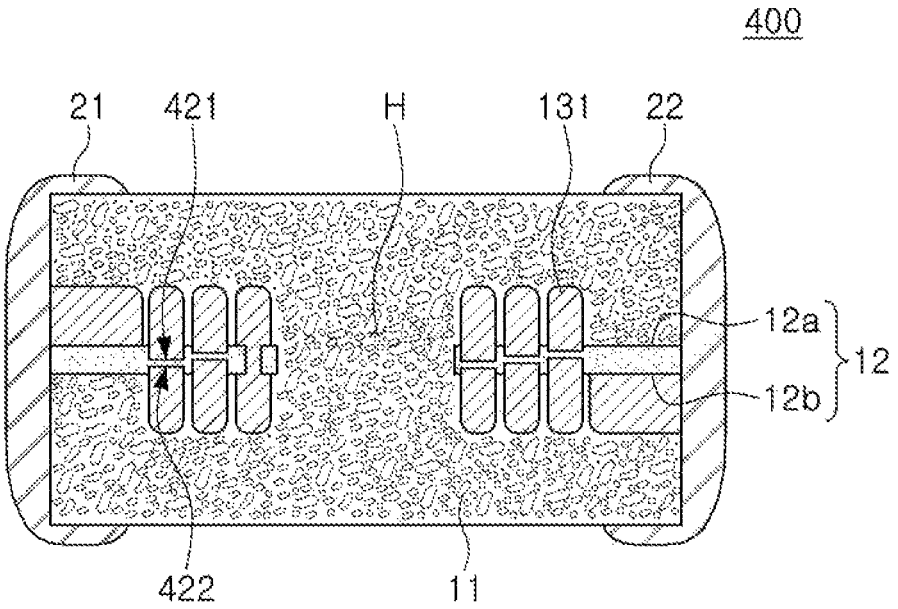
FIG. 6 is a schematic cross-sectional view taken along line I-I' of the coil component shown in FIG. 1, according to yet another embodiment.
Figure 7:
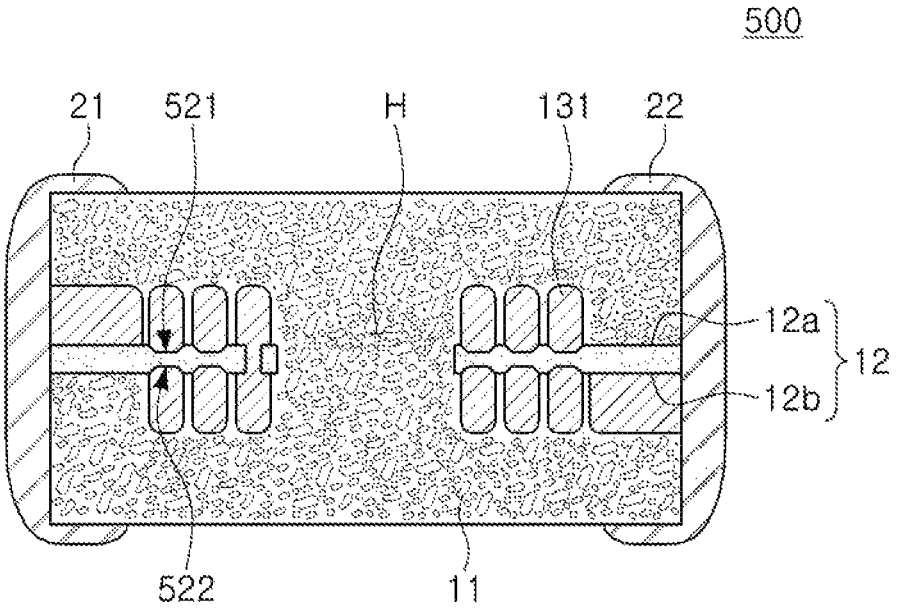
FIG. 7 is a schematic cross-sectional view taken along line I-I' of the coil component shown in FIG. 1, according to an additional embodiment.

FIGS. 5 through 7 illustrate modifications of an arrangement of the first and second grooves 121 and 122 included in the coil component 100 of FIG. 2. For convenience of description, the reference denotations of configurations overlapping those in FIG. 2 may be used in FIGS. 5 through 7, and repeated descriptions are omitted.

Referring to FIG. 5, a depth D3 of the first groove 321 formed in the upper surface 12*a* of the support member 12 is greater than a depth D4 of the second groove 322 formed in the lower surface 12*b* of the support member 12. Although not illustrated, in an embodiment, the support member 12 may have a groove formed in only the upper surface 12*a* thereof, without a groove being formed in the lower surface 12*b* thereof (i.e., the depth D4≈zero).

The coil component 300 of FIG. 5 may exhibit a significantly increased degree of freedom for a required electrical property value by differentiating AR ratios of the upper coil 131 and the lower coil 132.

Referring to FIG. 6, in a coil component 400, a depth of a first groove 421 disposed on the upper surface 12*a* of the support member 12 may vary as the coil 13 is wound, and a depth of a second groove 422 disposed on the lower surface 12*b* of the support member 12 may also vary as the coil 13 is wound.

The depth of the first groove 421 may be decreased in a direction inwardly (i.e., from the periphery of the body 1 to the center of the body 1) of the coil patterns. Conversely, the depth of the second groove 422 may be increased in the direction inwardly of the coil patterns. Changes in the depths may be suitably modified by a person of ordinary skill in the art, according to design particulars. In embodiments where a total thickness of the support member 12 is restricted, it may be advantageous to adjust the depth of the second groove 422 to be decreased, as the depth of the first groove 421 is increased.

Although not illustrated, similarly to the coil component 400 of FIG. 6, it may also be possible to adjust the depth of the first groove 421 to be increased in the direction inwardly of the coil patterns and to adjust the depth of the second groove 422 to be decreased in the direction inwardly of the coil patterns.

Referring to FIG. 7, a cross section of each of first and second grooves 521 and 522 of a coil component 500 may have a tapered shape whose width narrows in the direction inwardly of the support member 12.

A method for modifying a shape of the cross section of each of first and second grooves 521 and 522 is not limited, and the shape may be modified by a person of ordinary skill in the art through, for example, controlling intensity of a laser beam in etching a support member during a laser machining process. Each of the first and second grooves 521 and 522 may have the width that narrows in the direction inwardly of the support member 12. Thus, when etching the support member 12, the number of times of radiating a laser beam may be reduced, and, even when the total thickness of the support member 12 is relatively reduced, the degree of freedom for forming a groove shape may be increased.

Method for Fabricating Coil Component

FIGS. 8A through 8K are schematic cross-sectional views of the coil component in various stages of a method for fabricating a coil component, according to an embodiment. For convenience of description, the same reference denotations may be used for components overlapping those described above in FIGS. 1 and 2.

Figure 8A:
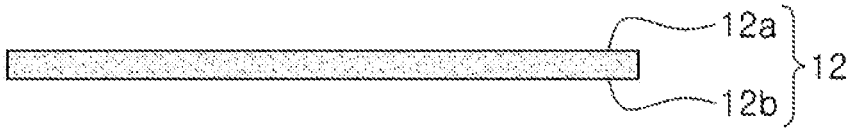
FIGS. 8A-8K schematically illustrate cross-section of a coil component at various steps during fabrication of the coil component using a method for fabricating a coil component, according to an embodiment.

FIG. 8A illustrates the support member 12. The support member 12 may be provided to form the coil 13, having a further reduced thickness, and to form the coil 13 more easily, and may be an insulating substrate formed of an insulating resin. The insulating resin may include a thermosetting resin such as an epoxy resin, a thermoplastic resin such as a polyimid, or a resin in which a stiffener such as a glass fiber or an inorganic filler is impregnated such as a PPG, an Ajinomoto build-up film (ABF), a FR-4 resin, a bismaleimide triazine (BT) resin, or a PID resin. When the support member 12 includes a glass fiber, stiffness of the support member 12 may be further improved.

Figure 8B:
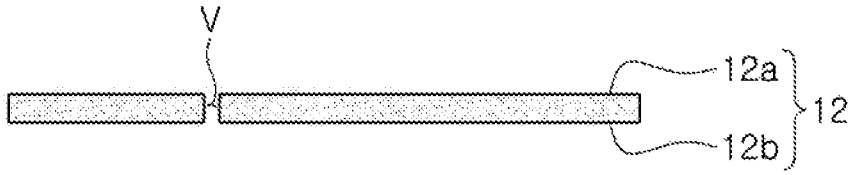

FIG. 8B illustrates a via hole V in the support member 12, formed using, for example, a UV laser. The via hole V may be provided to electrically connect the upper coil 131 and the lower coil 132 to be formed later. In an embodiment, a plurality of via holes is formed. A diameter and a number of the via holes V may be suitably selected by a person of ordinary skill in the art depending on desired device specifications.

Figure 8C:
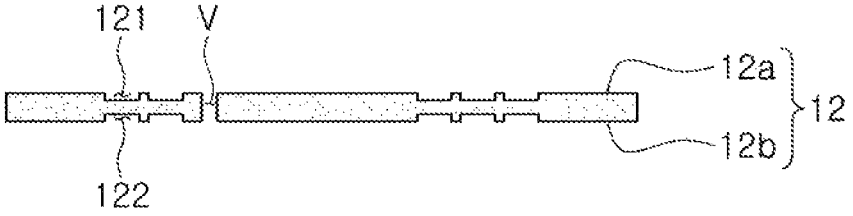

FIG. 8C illustrates the first and the second grooves 121 and 122 in the upper and lower surfaces 12*a* and 12*b* of the support member 12. In an embodiment, the first and the second grooves 121 and 122 are formed in only the upper surface 12*a* of the support member 12, and a shape, a depth, or the like of the cross section of each of the grooves 121 and 122 may also be suitably modified by a person of ordinary skill in the art, according to design particulars and requirements. A detailed method for forming the first and the second grooves 121 and 122 may be suitably selected by a person of ordinary skill in the art, according to properties of the support member 12, but is not particularly limited. The first and the second grooves 121 and 122 may be formed in the upper and lower surfaces 12*a* and 12*b* of the support member 12, such that the shape of each of the grooves 121 and 122 may correspond to the overall shape of the coil 13. When forming the grooves 121 and 122, whether the coil 13 has a spiral shape or a shape in which a plurality of quadrangles are repeated may be determined.

Figure 8D:
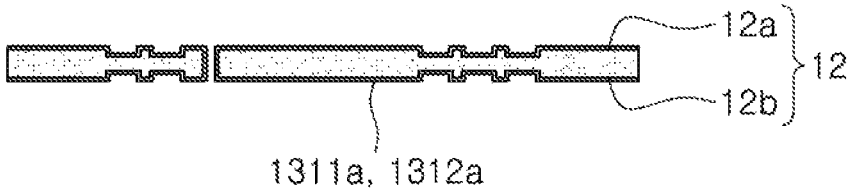

FIG. 8D illustrates the continuous base conductive layers 1311*a* and 1312*a* on side surfaces of the via hole V, the side surfaces and the lower surface of each of the first and the second grooves 121 and 122, and the upper and lower surfaces 12*a* and 12*b* of the support member 12. The base conductive layers 1311*a* and 1312*a* may substantially be seed patterns, and may be patterns that form a base of the coil patterns in forming the coil patterns for increasing the AR of the coil 13 on the base conductive layers 1311*a* and 1311*b*. A method for forming the base conductive layers 1311*a* and 1312*a* is not limited. For example, a sputtering method, a plating method, or the like may be used.

Figure 8E:
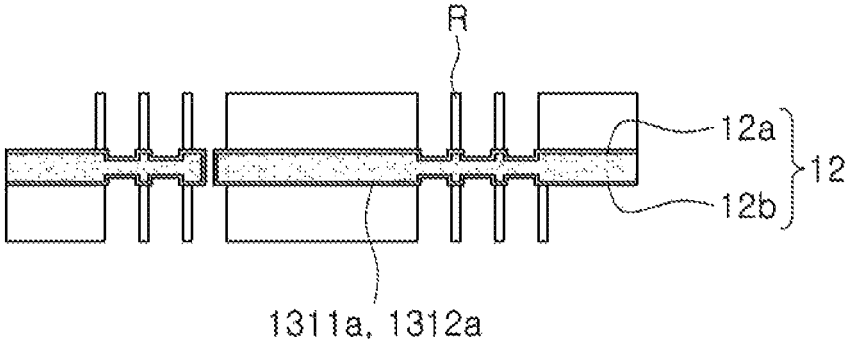

FIG. 8E illustrates insulating patterns R on the upper and lower surfaces 12*a* and 12*b* of the support member 12. A detailed method for forming the insulating patterns R is not limited. For example, a method may include stacking a plurality of insulating sheets on the upper and lower surfaces 12*a* and 12*b* of the support member 12 and then removing portions of the insulating sheets stacked on portions of the support member 12 in which the first and the second grooves 121 and 122 are formed. As a result, the insulating patterns R may be formed to substantially correspond to the overall shape of the coil 13 formed using the first and the second grooves 121 and 122.

A material of the insulating patterns R may be, for example, a resin, having improved insulation and processability properties. The insulating patterns R may be a photoresist pattern formed by exposing a photoresist to light and developing the exposed photoresist.

Figure 8F:
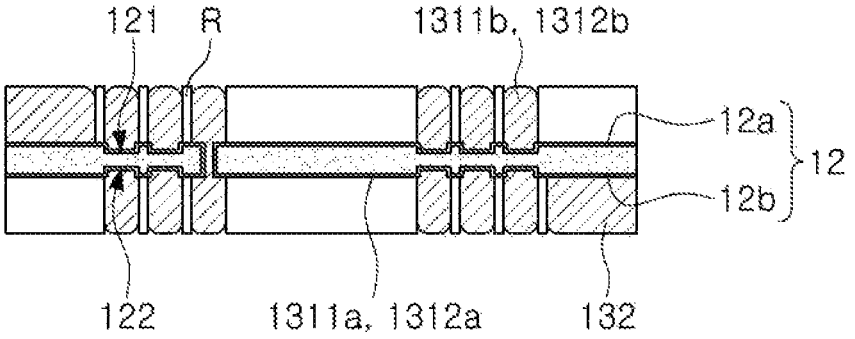

FIG. 8F illustrates the coil pattern layers 1311*b* and 1312*b* filling spaces between the insulating patterns R. A common Copper (Cu) plating process may be employed for forming of the coil pattern layers 1311*b* and 1312*b*. However, the present disclosure is not limited thereto.

When the coil pattern layers 1312*b* and 1312*b* fill the spaces between the insulating patterns R, the coil pattern layers 1312*b* and 1312*b* may be filled in the spaces, for example, to a level of upper surfaces of the coil pattern layers 1311*b* and 1312*b* that is lower than a level of upper surfaces of the insulating patterns R adjacent to the coil pattern layers 1311*b* and 1312*b*. The reason is that, when the coil pattern layers 1311*b* and 1312*b* fill the spaces to a level higher than the level of the upper surfaces of the insulating patterns R, a short circuit may occur between the adjacent coil patterns.

Further, the lower portions of the coil pattern layers 1311*b* and 1312*b* may be filled in the previously formed first and second grooves 121 and 122. In more detail, since the base conductive layers 1311*a* and 1312*a* are previously formed on the side surfaces and the lower surface of each of the first and the second grooves 121 and 122, the lower portions of the coil pattern layers 1311*b* and 1312*b* may be filled on the base conductive layers 1311*a* and 1312*a*.

Figure 8G:
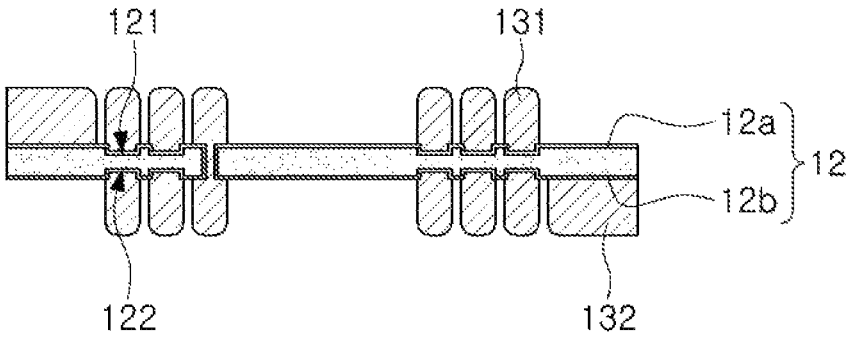

FIG. 8G illustrates cross-section of the coil component after the insulating patterns R formed in FIG. 8E are etched or removed. A method for etching or removing the insulating patterns R, such as a laser etching method, an etching method using a chemical solution, or the like, may be suitably selected according to a material and a thickness of the insulating patterns R.

Figure 8H:
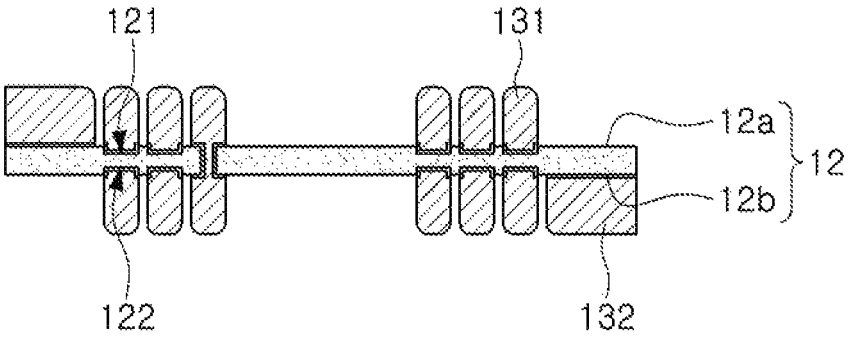

FIG. 8H illustrates cross-section of the coil component after removing portions of the base conductive layers 1311*a* and 1312*a* exposed by removing the insulating patterns R. Other portions of the base conductive layers 1311*a* and 1312*a* contacting the lower surfaces of the coil pattern layers 1311*b* and 1312*b* and disposed inside the first and the second grooves 121 and 122 may not be externally exposed subsequent to the removing of the insulating patterns R. Thus, the other portions of the base conductive layers may be left in the coil component.

Figure 8I:
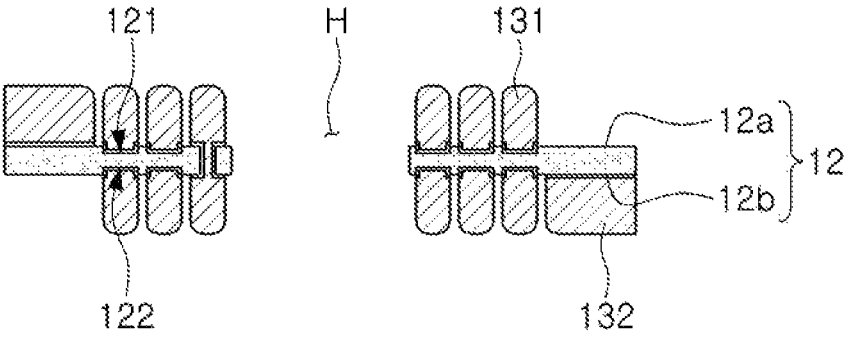

FIG. 8I illustrates the through hole H for increasing permeability, formed subsequent to the forming of the overall shape of the coil 13. A detailed method for forming the through hole H may be suitably selected by a person of ordinary skill in the art. For example, a mechanical drilling method or a laser drilling method may be used.

Figure 8J:
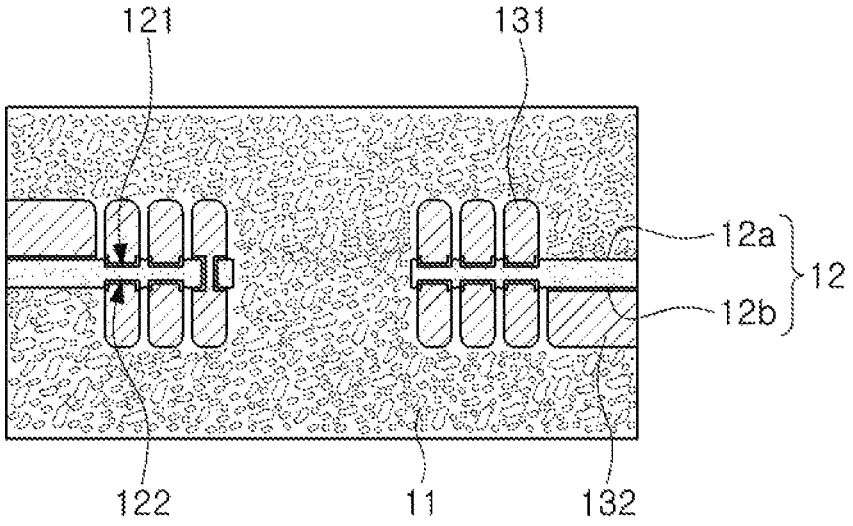

FIG. 8J illustrates the coil pattern layers 1311*a* and 1312*a* and the support member 12 encapsulated with the magnetic material 11. For example, the coil pattern layers 1311*b* and 1312*b* and the support member 12 may be encapsulated with the magnetic material 11, using a method for stacking a magnetic sheet including a composite material formed of a resin and a magnetic material. However, the present disclosure is not limited thereto. The magnetic sheet may fill the through hole H formed in FIG. 8I to increase permeability of the magnetic core.

Figure 8K:
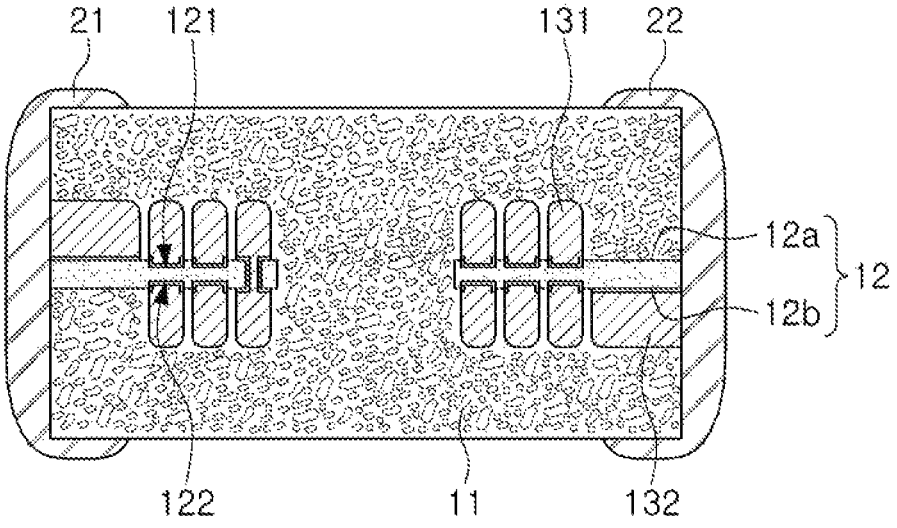

FIG. 8K illustrates the first and second external electrodes 21 and 22 to be electrically connected to the previously formed coil pattern layers 1311*a* and 1312*a*. Although not illustrated specifically, lead portions may be externally exposed through a dicing process or the like as portions through which the coil pattern layers 1311*b* and 1312*b* may be electrically connected to the first and second external electrodes 21 and 22. It may be sufficient that the first and second external electrodes 21 and 22 are implemented to have improved electrical conductivity and a sufficient degree of adhesion with the coil pattern layers 1311*b* and 1312*b*. A method for forming the first and second external electrodes 21 and 22 is not particularly limited.

As set forth above, according to an embodiment, a coil component having a high aspect ratio without using a copper clad laminate (CCL) commonly used to manufacture a thin film type power inductor, and a method for fabricating the coil component may be provided.

While embodiments have been shown and described above, it will be apparent to those skilled in the art that modifications and variations could be made without departing from the scope of the present disclosure, as defined by the appended claims.

What is claimed is:

1. A coil component, comprising:

a body comprising:

a support member including a through hole;

a coil disposed on at least one of an upper surface and a lower surface of the support member, the coil including a coil pattern; and a magnetic material encapsulating the coil and the support member, and filling the through hole; and an external electrode connected to the coil, wherein at least one of the upper surface and the lower surface of the support member includes a groove defined therein, at least a portion of the coil pattern is embedded in the groove, the groove has a shape corresponding to a shape of the portion of the coil pattern, and a depth of the groove corresponding to a portion of the coil pattern farthest away from the through hole is less than a depth of the groove corresponding to a portion of the coil pattern relatively closer to the through hole.

2. The coil component of claim 1, wherein the groove is formed to have a spiral shape.

3. The coil component of claim 1, wherein the groove is formed in the upper surface and the lower surface, and a depth of the groove formed in the upper surface is greater than a depth of the groove formed in the lower surface.

4. The coil component of claim 1, wherein the coil pattern includes a first coil pattern and a second coil pattern directly adjacent to the first coil pattern, each disposed on the upper surface, the second coil pattern being connected to the first coil pattern, and a depth to which the first coil pattern is embedded in the groove is greater than a depth to which the second coil pattern is embedded in the groove.

5. The coil component of claim 1, wherein the coil pattern includes an embedded coil pattern portion embedded in the groove, and an exposed coil pattern portion, and a cross-sectional area of the embedded coil pattern portion is the same as a cross-sectional area of the exposed coil pattern portion.

6. The coil component of claim 1, wherein an insulating film is disposed on the coil pattern.

7. The coil component of claim 1, wherein a cross section of the groove has a tapered shape whose width narrows in a direction inwardly of the support member.

8. The coil component of claim 1, wherein a first groove is formed in the upper surface and a second groove is formed in the lower surface, and each of a depth of the first groove the second groove varies as the coil is wound.

9. The coil component of claim 1, the depth of the groove formed on the upper surface of the support member and the depth of the groove formed on the lower surface of the support member are different from each other.

* * * * *